US010920760B2

(12) United States Patent
Kotani et al.

(10) Patent No.: US 10,920,760 B2
(45) Date of Patent: Feb. 16, 2021

(54) AIR COMPRESSOR HAVING AN OIL SEPARATOR, AN OIL COOLER, FIRST AND SECOND EVAPORATORS, AND WHEREIN INTAKE AIR AND THE OIL ARE SIMULTANEOUSLY COOLED IN THE FIRST AND SECOND EVAPORATORS

(71) Applicant: Hitachi, Ltd., Tokyo (JP)

(72) Inventors: Masanao Kotani, Tokyo (JP); Takeshi Tsuchiya, Tokyo (JP); Ryoji Kawai, Tokyo (JP); Sachio Sekiya, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 175 days.

(21) Appl. No.: 16/065,499

(22) PCT Filed: Oct. 19, 2016

(86) PCT No.: PCT/JP2016/080891
§ 371 (c)(1),
(2) Date: Jun. 22, 2018

(87) PCT Pub. No.: WO2017/110220
PCT Pub. Date: Jun. 29, 2017

(65) Prior Publication Data

US 2019/0024651 A1 Jan. 24, 2019

(30) Foreign Application Priority Data

Dec. 25, 2015 (JP) ..... JP2015-252810

(51) Int. Cl.
*F04B 39/06* (2006.01)
*F04B 39/16* (2006.01)
(Continued)

(52) U.S. Cl.
CPC ..... *F04B 39/06* (2013.01); *F04B 39/02* (2013.01); *F04B 39/0207* (2013.01);
(Continued)

(58) Field of Classification Search
CPC ..... F04B 39/06; F04B 39/02; F04B 39/0207; F04B 39/16; F04B 41/06; F25B 5/02;
(Continued)

(56) References Cited

U.S. PATENT DOCUMENTS 3,785,755 A * 1/1974 Novak ..... F04C 29/0007 418/85
3,795,117 A * 3/1974 Moody, Jr. ..... F04C 29/042 62/197

(Continued)

FOREIGN PATENT DOCUMENTS

JP 58-77165 U 5/1983
JP 2000-205134 A 7/2000
JP 2005-83219 A 3/2005

OTHER PUBLICATIONS

International Search Report (PCT/ISA/210) issued in PCT Application No. PCT/JP2016/080891 dated Jan. 17, 2017 with English translation (two (2) pages).

(Continued)

*Primary Examiner* — Patrick Hamo
*Assistant Examiner* — Benjamin Doyle
(74) *Attorney, Agent, or Firm* — Crowell & Moring LLP

(57) ABSTRACT

An oil—cooled air compressor is provided with: an oil—cooled air compressor for compressing sucked-in air and discharging the compressed air; an oil separator for separating the compressed air and lubricating oil, which are discharged from the air compressor body; an oil cooler for cooling, by outside air, lubricating oil discharged from the oil separator; oil supply pipe passage for supplying lubricating oil, which is discharged from the oil cooler, to a bearing of the air compressor body and to an intermediate section in the process of compression by the air compressor; and an after-cooler for cooling, by outside air, air discharged from the oil separator. The oil-cooled air compressor in (Continued)

which the air compressor, the oil separator, the oil cooler, and the after-cooler are connected to supply high-pressure air to the outside of the compressor is provided with a vapor compression type refrigeration cycle.

12 Claims, 7 Drawing Sheets

(51) Int. Cl.

| | |
|---|---|
| ***F25B 5/04*** | (2006.01) |
| ***F04B 39/02*** | (2006.01) |
| ***F25B 5/02*** | (2006.01) |
| ***F04B 41/06*** | (2006.01) |
| ***F25B 31/00*** | (2006.01) |

(52) U.S. Cl.
CPC ..... *F04B 39/16* (2013.01); *F04B 41/06* (2013.01); *F25B 5/02* (2013.01); *F25B 5/04* (2013.01); *F25B 31/004* (2013.01)

(58) Field of Classification Search
CPC ..... F25B 5/04; F25B 31/004; F04C 29/0007; F04C 29/04; F04C 29/042
USPC ..... 417/228, 313
See application file for complete search history.

(56) References Cited

U.S. PATENT DOCUMENTS 3,856,493 A * 12/1974 Bulkley ..... F04C 29/04 62/401
4,936,109 A * 6/1990 Longardner ..... F04D 29/5826 62/238.3
5,087,178 A * 2/1992 Wells ..... B01D 53/261 418/1
5,171,130 A * 12/1992 Kume ..... F04B 39/04 184/6.16
5,318,151 A * 6/1994 Hood ..... F04C 29/021 184/6.1
5,653,585 A * 8/1997 Fresco ..... F04C 18/16 418/100
5,699,673 A * 12/1997 Hoshino ..... B01D 53/265 62/93
5,724,821 A * 3/1998 Lord ..... F04C 29/021 62/193
5,899,091 A * 5/1999 Fraser, Jr. ..... F25B 31/002 62/473
6,058,727 A * 5/2000 Fraser, Jr. ..... F25B 31/002 62/190
2011/0000227 A1* 1/2011 Kamiya ..... F04C 23/006 62/6
2011/0056226 A1* 3/2011 Okubo ..... H02P 29/68 62/208
2013/0156548 A1* 6/2013 Takano ..... F25B 43/02 415/114
2013/0333781 A1* 12/2013 Itadani ..... B60H 1/00271 137/565.18
2014/0102103 A1* 4/2014 Yamamoto ..... F01K 15/00 60/658
2016/0186757 A1* 6/2016 Collins ..... F04C 18/16 418/83
2017/0101991 A1* 4/2017 Yenneti ..... F04C 29/0092

OTHER PUBLICATIONS

Japanese-language Written Opinion (PCT/ISA/237) issued in PCT Application No. PCT/JP2016/080891 dated Jan. 17, 2017 (four (4) pages).

* cited by examiner

AIR COMPRESSOR HAVING AN OIL SEPARATOR, AN OIL COOLER, FIRST AND SECOND EVAPORATORS, AND WHEREIN INTAKE AIR AND THE OIL ARE SIMULTANEOUSLY COOLED IN THE FIRST AND SECOND EVAPORATORS

TECHNICAL FIELD

The present invention relates to an air compressor.

BACKGROUND ART

JP-A-2005-83219 discloses a conventional oil-cooled air compressor. In this technique, in an air compressor including: an oil-cooled compressor body that compresses air; an oil separator and collector that separates and collects oil accompanying compressed air discharged from the oil-cooled compressor body; an air cooling section that cools the compressed air sent out from the oil separator and collector; a dehumidifying section that cools the compressed air cooled by the air cooling section to its dew point in an evaporation process in a refrigeration circuit that continuously circulates a refrigerant, and precipitates drain water from the compressed air; and an oil cooler interposed in an oil flow passage for returning the collected oil to the oil-cooled compressor body for injection of the oil, only the compressed air passing through the dehumidifying section is used as a cooling medium in the air cooling section, whereby a volumetric flow rate of air supplied to the outside of the air compressor is increased. Further, this document also discloses a technique of incorporating the oil cooler directly under a capillary tube of the refrigeration circuit, using the refrigerant in the evaporation process as the cooling medium to simplify oil cooling by blowing, and reducing power for oil cooling.

CITATION LIST

Patent Literature

PATENT LITERATURE 1: JP-A-2005-83219

SUMMARY OF INVENTION

Technical Problem

Incidentally, it has been generally well known that when low temperature lubricating oil to be supplied during compression is supplied and the compressed air is cooled, power consumption of the air compressor can be suppressed. On the other hand, temperature of the compressed air rises as pressure rises, but in a case where moisture is contained in the compressed air, dew point temperature at which moisture in the air condenses also rises. For example, a dew point temperature of air, at a temperature of 25° C. and at a relative humidity of 55%, is about 15° C., while in a case where the air is compressed to a pressure of 430 kPa, the dew point temperature becomes 40° C., and in a case where the air is compressed to 800 kPa, the dew point temperature becomes 52° C. For this reason, if low temperature lubricating oil having the dew point temperature or lower is supplied during compression, moisture in the compressed air condenses, which is a cause of remarkably decreasing reliability of the lubricating oil. Therefore, a temperature of the lubricating oil supplied during compression is limited by the dew point temperature.

In Patent Literature 1, the power for cooling the lubricating oil can be reduced by using a refrigeration cycle, but the change in the dew point temperature during compression described above is not taken into consideration. For this reason, supply temperature of the lubricating oil is limited to the dew point temperature or more. For this reason, the reduction effect of the compression power for compressing the air has been restricted.

Solution to Problem

To solve the above-described problem, in an air compressor being an oil-cooled air compressor including: an oil-cooled air compressor that compresses intake air and discharges the air; an oil separator that separates compressed air discharged from the air compressor body and lubricating oil from each other; an oil cooler that cools the lubricating oil discharged from the oil separator with outside air; an oil supply pipeline for supplying the lubricating oil discharged from the oil cooler to a bearing of the air compressor body and an intermediate part of the air compressor during compression; and an aftercooler that cools the air discharged from the oil separator with the outside air, in which the air compressor, the oil separator, the oil cooler, and the aftercooler are connected together to supply high pressure air outside the compressor, the air compressor includes a refrigeration cycle of a vapor compression type, in which the refrigeration cycle is constructed by annularly connecting a refrigerant compressor, a condenser, an expansion valve, a first evaporator, and a second evaporator together, and cooling and dehumidification of the intake air of the air compressor and cooling of the lubricating oil are performed simultaneously by causing the intake air taken into the air compressor to flow through a primary side of the first evaporator, causing the refrigerant to flow through a secondary side of the first evaporator, causing the lubricating oil to flow through a primary side of the second evaporator, and causing the refrigerant to flow through a secondary side of the second evaporator.

Advantageous Effects of Invention

As described above, according to the present invention, condensation does not occur in the compressor even in a case where the low temperature lubricating oil is supplied to the air during compression. As a result, an air compressor can be provided that reduces the power related to air compression, and is excellent in energy saving and reliability, without impairing the reliability of the lubricating oil of the air compressor and the air compressor body.

DESCRIPTION OF EMBODIMENTS

Preferred embodiments for carrying out the present invention will be described below with reference to the drawings. It should be noted that the following is merely an example of implementation, and the contents of the invention is not limited to the following specific embodiments. It goes without saying that the present invention can be modified into various aspects including the following aspects.

First Embodiment

An outdoor unit of an air conditioner according to a first embodiment will be described below with reference to FIGS. 1 to 4.

Figure 1:
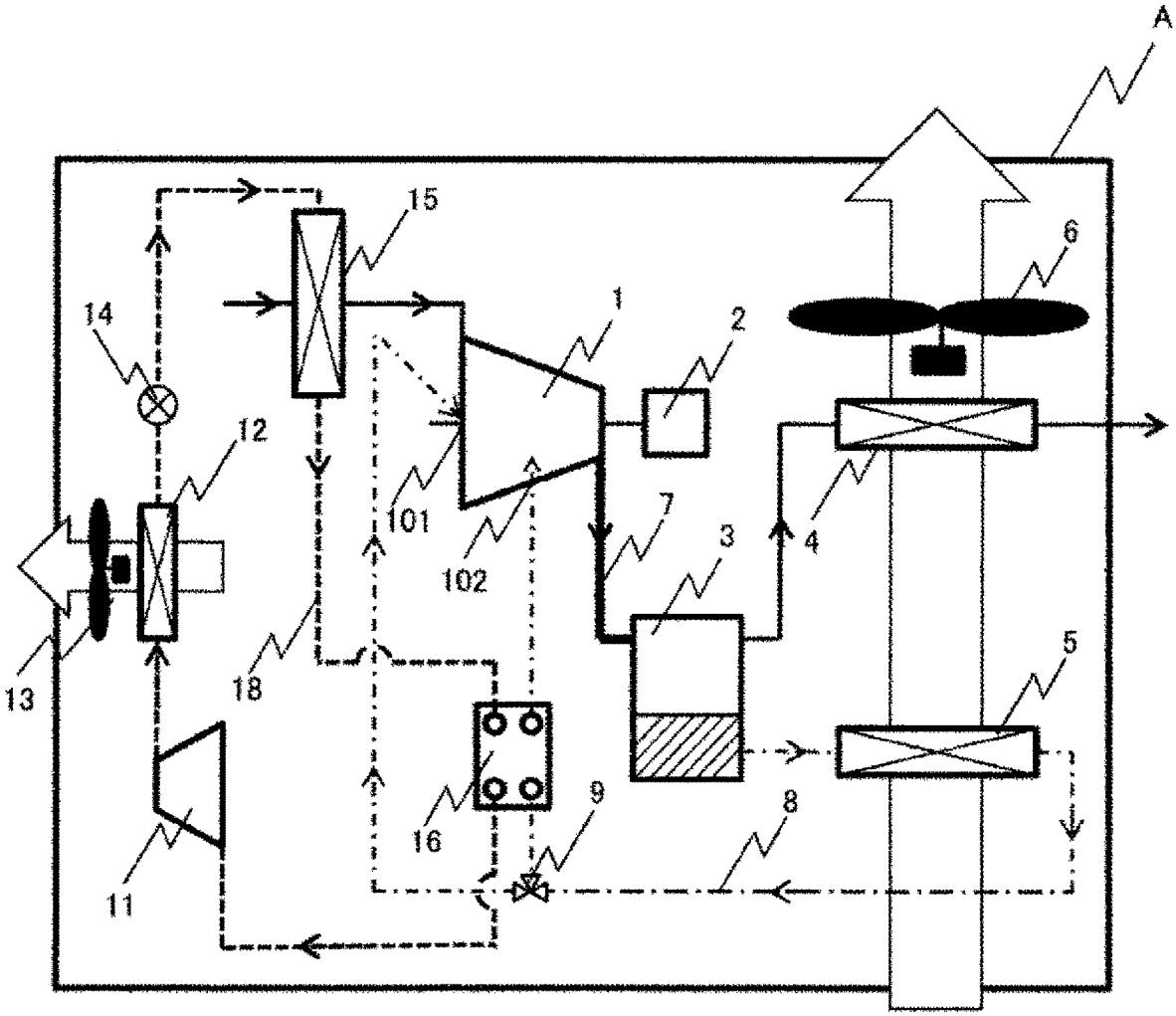
FIG. 1 shows a schematic diagram of an air compression unit in a first embodiment.

FIG. 1 illustrates an air compression unit A, and as illustrated in the drawing, the air compression unit A includes an air compression section including: an air compressor 1 that compresses air taken in from the atmosphere; a motor 2 that drives the air compressor 1; an oil separator 3 that separates compressed air containing oil into oil and air; an aftercooler 4 that cools the compressed air; an oil cooler 5 that cools lubricating oil; an air blower 6 for ventilating (indicated by an arrow-mark "⇒" in the figure) the aftercooler 4 and the oil cooler 5; an air ventilation passage 7 (a pipeline indicated by the solid line in the figure) for conducting the compressed air; an oil circulation passage 8 (a pipeline indicated by the dashed line in the figure) for circulating the lubricating oil; and an oil supply control valve 9, and a refrigeration cycle section including: a refrigerant compressor 11; a condenser 12; a blower 13 for ventilating (indicated by ⇒ in the figure) the condenser; an expansion valve 14; a first evaporator 15; a second evaporator 16, and a refrigerant circulation passage 18 (a pipeline indicated by the broken line in the figure) for circulating a refrigerant. Drain water generated in the first evaporator 15, the aftercooler, or the like is drained through a drain trap or the like not illustrated in the figure. The air compression unit A configured as described above operates as follows.

The air taken into the air compression unit A is cooled and dehumidified by the refrigerant that is a cooling medium in the first evaporator 15, and then flows into the air compressor 1, is compressed by the air compressor 1 with the lubricating oil supplied from an intermediate oil supply part 102 and a bearing oil supply part 101 to become high temperature and high pressure air, and is discharged from the air compressor 1. The compressed air discharged from the air compressor 1 is separated from the lubricating oil by the oil separator 3 and flows into the aftercooler 4. The compressed air flowing into the aftercooler exchanges heat with the atmosphere blown to the aftercooler by the blower 6, decreases the temperature to the operating temperature range, and is discharged to the outside of the air compression unit A and is used as compressed air.

The lubricating oil separated from the compressed air by the oil separator 3 flows into the oil cooler 5. Similarly to the compressed air, the lubricating oil flowing into the oil cooler exchanges heat with the atmosphere blown to the oil cooler 5 by the blower 6, and decreases the temperature and flows out from the oil cooler 5. Part of the lubricating oil flowing out from the oil cooler 5 flows into the second evaporator 16, exchanges heat with the refrigerant in the second evaporator 16, and decreases the temperature to a cooling temperature at which the compressed air of the intermediate oil supply part 102 is cooled. The lubricating oil flowing out from the second evaporator 16 returns to the air compressor 1 from the intermediate oil supply part 102 to cool the air during compression. On the other hand, part of the lubricating oil not flowing into the second evaporator 16 is supplied to a bearing of the air compressor 1 from the bearing oil supply part 101 of the air compressor, and then returns to the intake part of the air compressor 1. A circulating oil amount of the lubricating oil is controlled by the oil supply control valve 9.

During operation of the air compression section, the refrigerant operates as follows in the refrigeration cycle section. The refrigerant flowing into the refrigerant compressor 11 is compressed by the refrigerant compressor 11 to become a high temperature and high pressure gas and is discharged from the refrigerant compressor 11. The gas refrigerant discharged from the refrigerant compressor 11 flows into the condenser 12. In the condenser 12, the refrigerant exchanges heat with the atmosphere blown to the condenser 12 by the blower 13, and radiates heat to the atmosphere to be condensed and liquefied. The condensed and liquefied refrigerant flows into the expansion valve 14, adiabatically expands at the expansion valve 14 to become a low temperature two-phase state, and flows out from the expansion valve 14. At this time, a throttle amount (or opening degree) of the expansion valve 14 is controlled such that an evaporation pressure is achieved at which the temperature of the refrigerant is at least lower than the dew point temperature of the atmosphere (intake air that is taken into the air compression unit A and flows into the air compressor 1). The low temperature two-phase state refrigerant flows into the first evaporator 15, and exchanges heat with the atmosphere taken into the air compression unit A to be heated. At this time, the atmosphere exchanging heat with the refrigerant is cooled and dehumidified, and reaches predetermined intake temperature and humidity. The refrigerant flowing out from the first evaporator 15 flows into the second evaporator 16. In the second evaporator 16, the refrigerant exchanges heat with the lubricating oil flowing out from the oil cooler 5 to be heated. At this time, the lubricating oil is cooled to a predetermined temperature by the refrigerant. The refrigerant flowing out from the second evaporator 16 is returned to the refrigerant compressor 11 to construct a refrigeration cycle.

Figure 2:
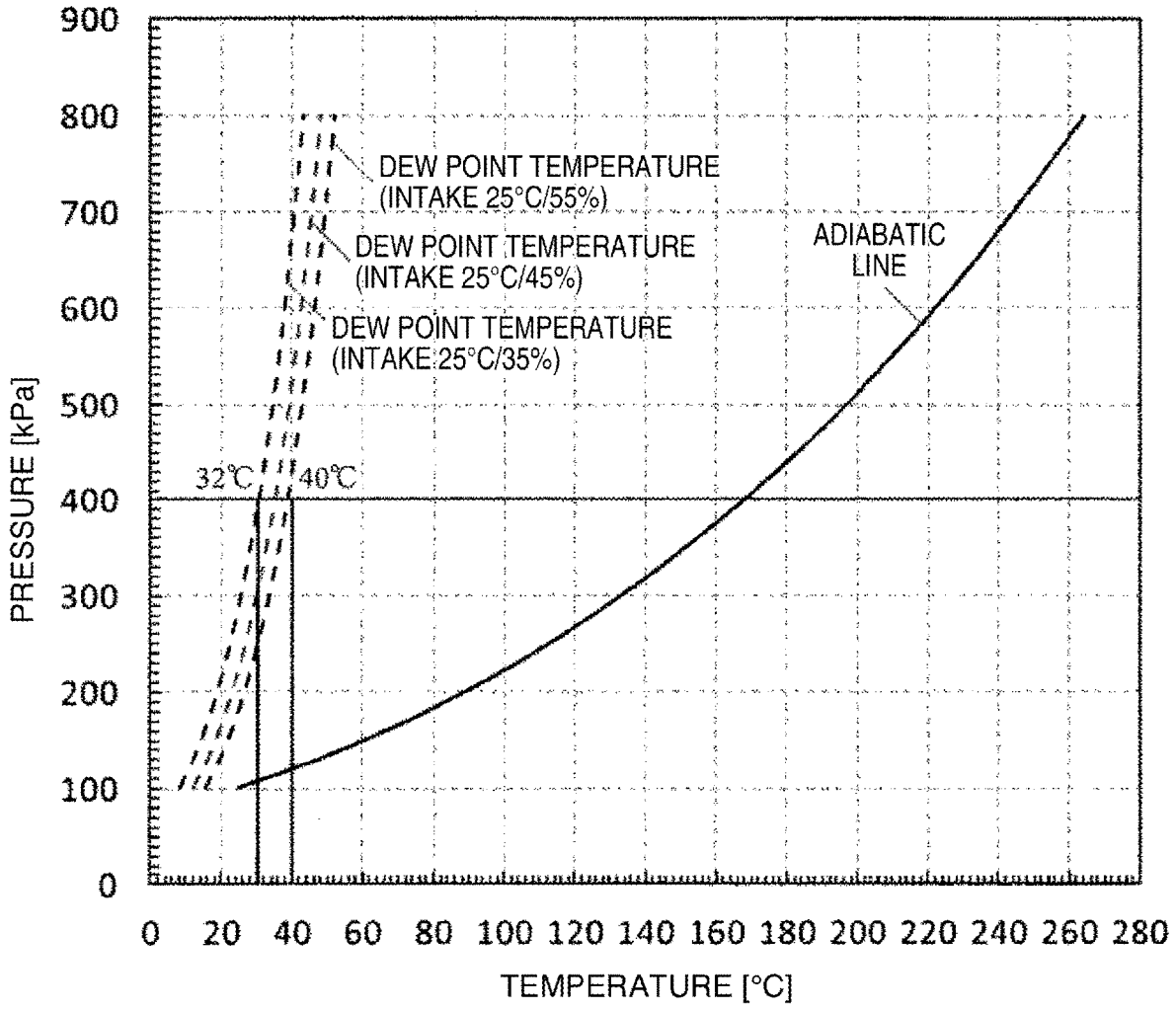
FIG. 2 shows a graph illustrating a change in dew point temperature at each pressure.
Figure 3:
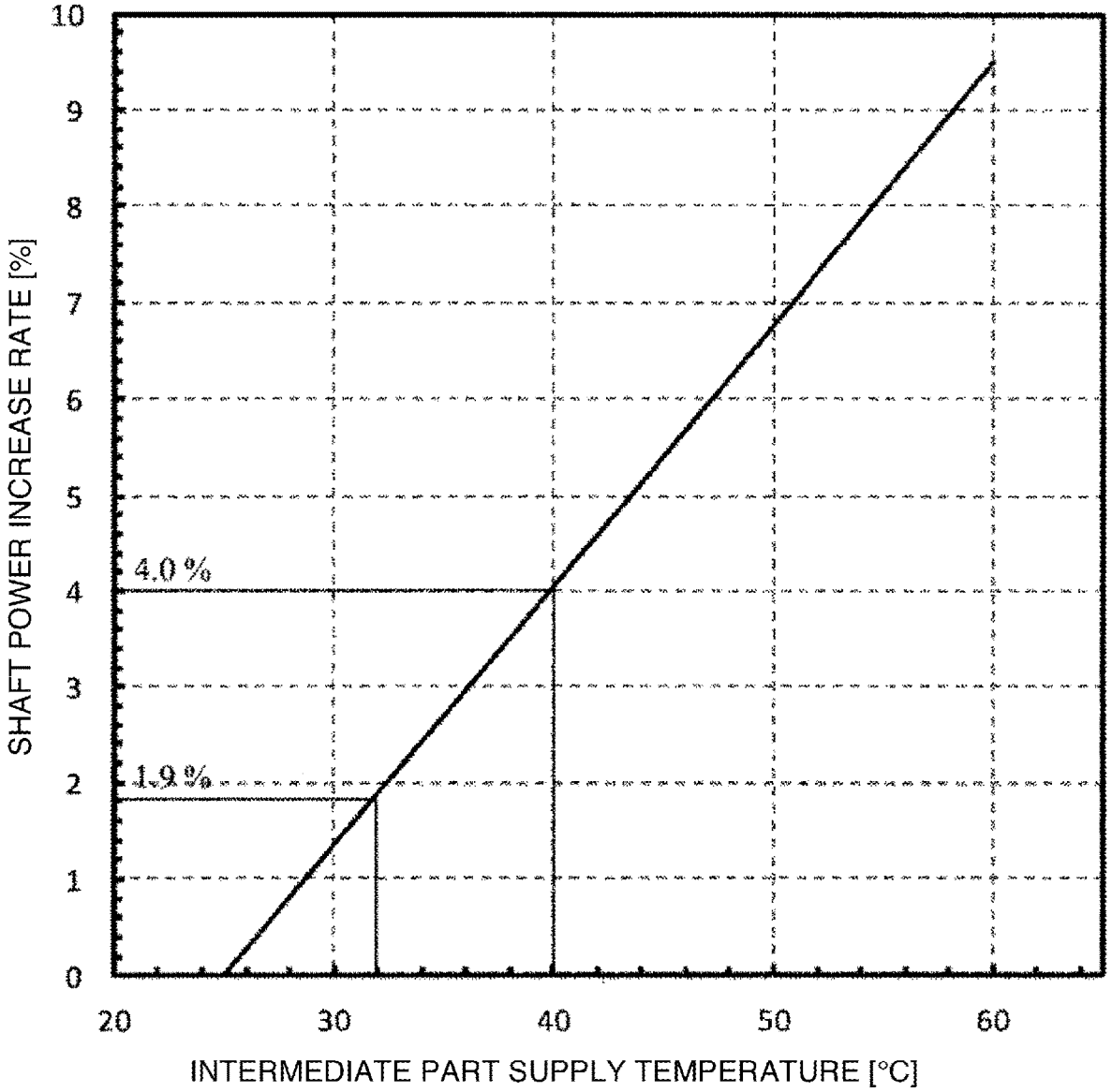
FIG. 3 shows a graph illustrating an increase rate of shaft power.

The air compression unit A is constructed by the air compression section and the refrigeration cycle section, whereby the air taken into the air compressor 1 can be cooled and dehumidified. As a result, the dew point temperature of the compressed air in the intermediate oil supply part 102 can be made lower than the dew point temperature of a case where the atmosphere is taken in as it is. FIG. 2 illustrates an adiabatic line when the intake air of a temperature of 25° C. and a relative humidity of 55% is compressed to 800 kPa by the refrigerant compressor 11, and a change in dew point temperature at each pressure in a case where the relative humidity is changed to 35%, 45%, and 55%. The solid line in the figure illustrates the adiabatic line and the broken line illustrates the change in dew point temperature. For example, in a case where the intermediate oil supply part 102 is provided at a position where the pressure (about 400 kPa) is about one-half of the pressure of the discharged air, the dew point temperature can be changed from 40° C. to 32° C. by changing the relative humidity of the intake air from 55% to 35%. As a result, in the air compression unit A according to the present invention, even if lower temperature lubricating oil is introduced by the intermediate oil supply part 102, moisture in the air does not condense in the compressed air by cooling. In addition, since a relatively high dew point temperature can be kept even in a high pressure section, the intermediate oil supply part 102 can be provided in a part with a relatively high pressure. FIG. 3 illustrates an increase rate of shaft power in a case where an oil supply temperature of the intermediate oil supply part 102 is changed from 25° C. to 60° C. It can be seen that in a case where the temperature of the lubricating oil is set to 32° C., the shaft power increases by 1.9% compared to a case where the temperature is set to 25° C., and in a case where temperature is set to 40° C., the shaft power increases by 4.0%. From the above, according to the air compression unit A of the present embodiment, the dew point temperature of the air in the intermediate oil supply part 102 can be kept low by dehumidifying the intake air, so that there is no condensation due to supply of the low temperature lubricating oil. As a result, the low temperature lubricating oil can be supplied from the intermediate oil supply part 102, and energy saving of the air compressor 1 can be improved.

Figure 4:
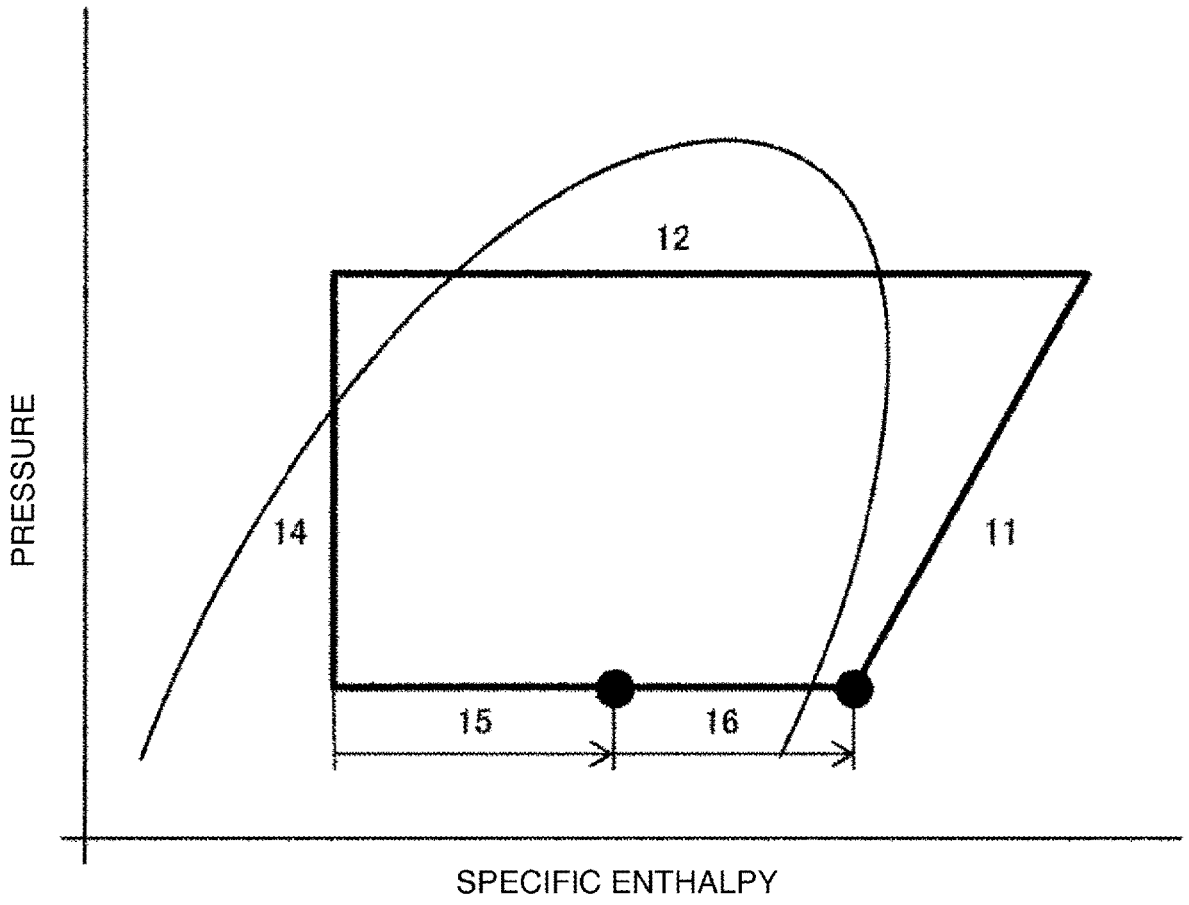
FIG. 4 shows a pressure-specific enthalpy diagram of a refrigerant of a refrigeration cycle section.

Further, in the refrigeration cycle section, the first evaporator 15 that cools and dehumidifies the intake air and the second evaporator 16 that cools the lubricating oil are arranged such that the refrigerant flows through the first evaporator 15 and the second evaporator 16 in this order. FIG. 4 illustrates the pressure-specific enthalpy diagram of the refrigerant in the refrigeration cycle section. As can be seen from FIG. 4, in a region in which a low temperature medium is required for such as cooling and dehumidifying the intake air, the two-phase region of the refrigerant can be preferentially used. As a result, dehumidification efficiency of the intake air can be improved. Further, regarding the refrigerant, since the heating region is used in the second evaporator 16, flow directions of the lubricating oil and the refrigerant of the second evaporator 16 are made to be opposite to each other. In the second evaporator, the refrigerant changes its state from the two-phase region to the heating region, so that the temperature of the refrigerant also rises toward the outlet, but since the flows of the lubricating oil and the refrigerant are made to be opposite to each other, a temperature difference can be maintained between the lubricating oil and the refrigerant. For this reason, even in a case where the temperature difference is relatively small, temperature efficiency of the second evaporator can be kept high. The configuration of the evaporator of the refrigeration cycle section is constructed as described above, whereby the refrigeration cycle can be operated at an appropriate operating point. As a result, energy consumption consumed in the refrigeration cycle section can be kept low.

Further, in the present embodiment, the number of revolutions of the refrigerant compressor 11 is controlled in accordance with the intake air temperature and humidity, and the opening degree of the expansion valve is controlled in accordance with the number of revolutions of the refrigerant compressor 11 and the intake air temperature and humidity. As a result, the temperature of the lubricating oil supplied to the intermediate oil supply part 102 can be controlled to a temperature corresponding to the intake air flowing into the air compressor 1 for air. From the above, the air compression unit A provided according to the present embodiment can be made to be highly reliable, and energy saving of the system can also be improved.

In the present embodiment, the intermediate oil supply part 102 is described by a single point; however, a similar effect can be obtained also in a case where a plurality of intermediate oil supply parts 102 is provided. Also in the case of pressure, a similar effect can be exerted even in a case where the plurality of intermediate oil supply parts 102 is provided at several stages of pressure points to supply oil.

Second Embodiment

Figure 5:
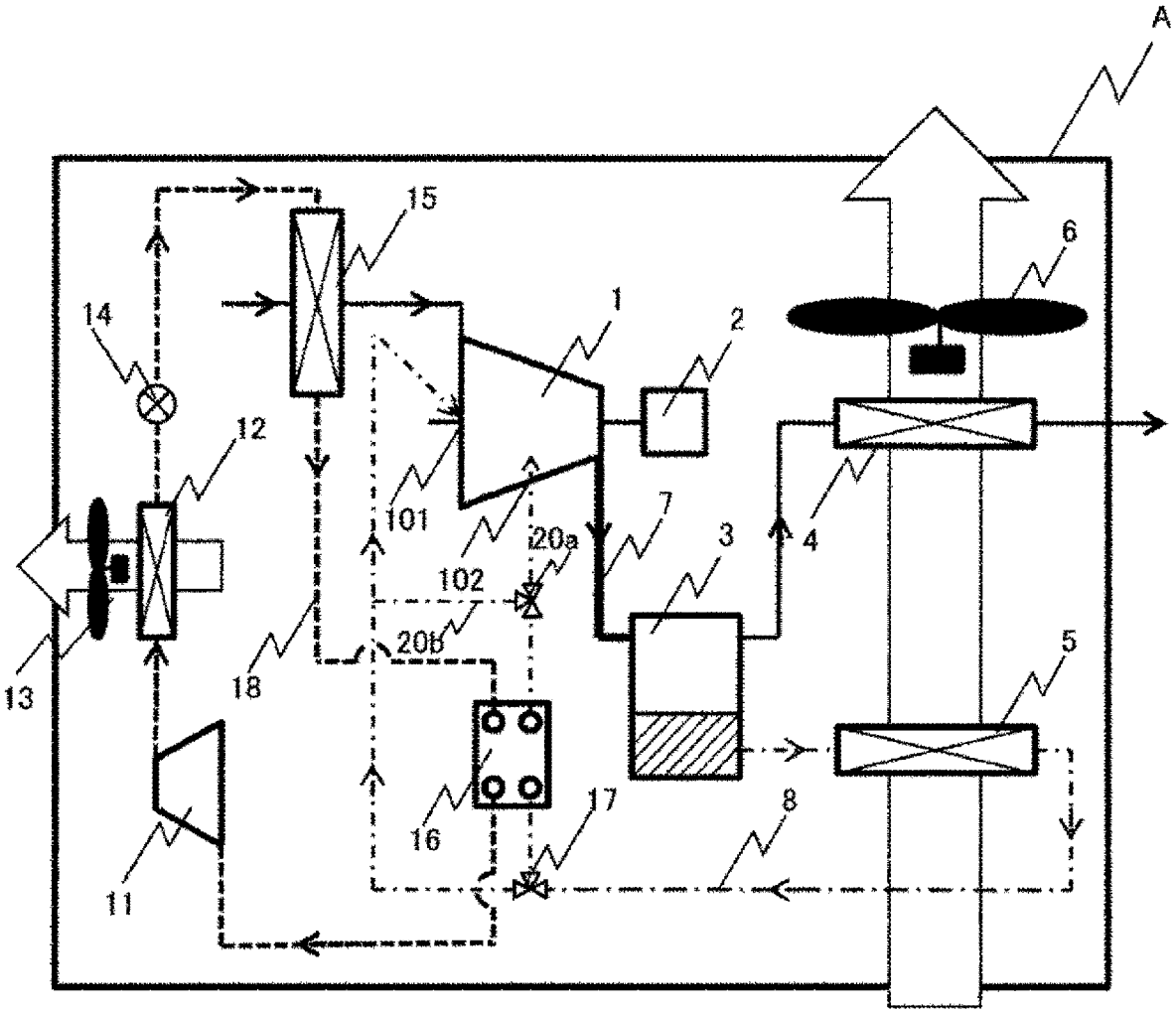
FIG. 5 shows a schematic diagram of an air compression unit in a second embodiment.

FIG. 5 illustrates a second embodiment in which a three-way valve 20*a* and a bypass pipeline 20*b* are provided in the intermediate oil supply part illustrated in the first embodiment. Since the bypass pipeline 20*b* provided downstream of the second evaporator 16 is joined to a pipeline for bearing oil supply, in a case where the temperature of the outside air is relatively high, a mixing ratio of low temperature oil (oil flowing through the bypass pipeline 20*b*) and high temperature oil (oil bypassing the second evaporator 16) is controlled, whereby oil supply temperature to be supplied to the bearing can be appropriately maintained. As a result, reliability and efficiency of the compressor can be improved.

Third Embodiment

Figure 6:
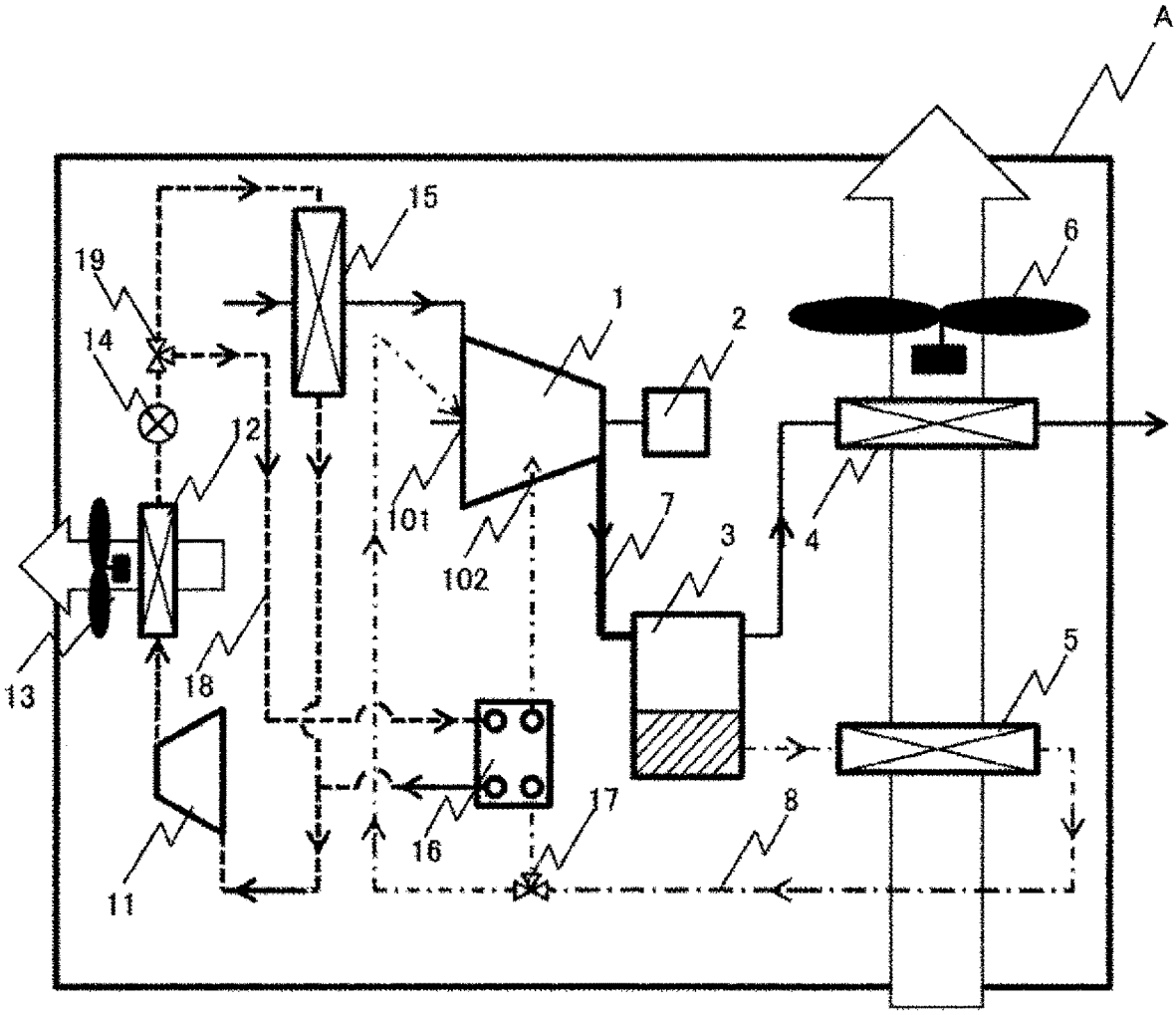
FIG. 6 shows a schematic diagram of an air compression unit in a third embodiment.

FIG. 6 illustrates a third embodiment different from the first embodiment. Similarly to the first embodiment, an air compression unit A in the third embodiment is also includes an air compression section and a refrigeration cycle section. Since operation of the air compression section is similar to that of the first embodiment, a description of the configuration will be omitted here. The refrigeration cycle section includes: a refrigerant compressor 11; a condenser 12; a blower 13 for ventilating the condenser; an expansion valve 14; a first evaporator 15; a second evaporator 16; a refrigerant circulation passage 18 (a pipeline indicated by the broken line in the figure) for circulating a refrigerant; and a refrigerant flow regulating valve 19 that adjusts a flow rate of the refrigerant flowing to the first evaporator 15 and the second evaporator 16. Similarly to the first embodiment, drain water generated in the first evaporator 15, the aftercooler, or the like is drained through a drain trap or the like not illustrated in the figure. The refrigeration cycle section of the air compression unit A configured as described above operates as follows.

The refrigerant flowing into the refrigerant compressor 11 is compressed by the refrigerant compressor 11 to become a high temperature and high pressure gas and is discharged from the refrigerant compressor 11. The gas refrigerant discharged from the refrigerant compressor 11 flows into the condenser 12. In the condenser 12, the refrigerant exchanges heat with the atmosphere blown to the condenser 12 by the blower 13, and radiates heat to the atmosphere to be condensed and liquefied. The condensed and liquefied refrigerant flows into the expansion valve 14, adiabatically expands at the expansion valve 14 to become a low temperature two-phase state, and flows out from the expansion valve 14. At this time, a throttle amount (or opening degree) of the expansion valve 14 is controlled such that an evaporation pressure is achieved at which the temperature of the refrigerant is at least lower than the dew point temperature of the atmosphere (intake air that is taken into the air compression unit A and flows into the refrigerant compressor 11). Part of the refrigerant flowing out from the expansion valve 14 flows into the first evaporator 15 via the refrigerant flow regulating valve 19, and exchanges heat with the atmosphere taken into the air compression unit A to be heated. At this time, the atmosphere exchanging heat with the refrigerant is cooled and dehumidified, and reaches predetermined intake temperature and humidity. On the other hand, the refrigerant other than the refrigerant flowing into the first evaporator 15 flows into the second evaporator 16. In the second evaporator 16, the refrigerant exchanges heat with the lubricating oil flowing out from the oil cooler 5 to be heated. At this time, the lubricating oil is cooled to a predetermined temperature by the refrigerant. The refrigerant flowing out from the first evaporator 15 and the second evaporator 16 joins and returns to the refrigerant compressor 11 to construct a refrigeration cycle.

Figure 7:
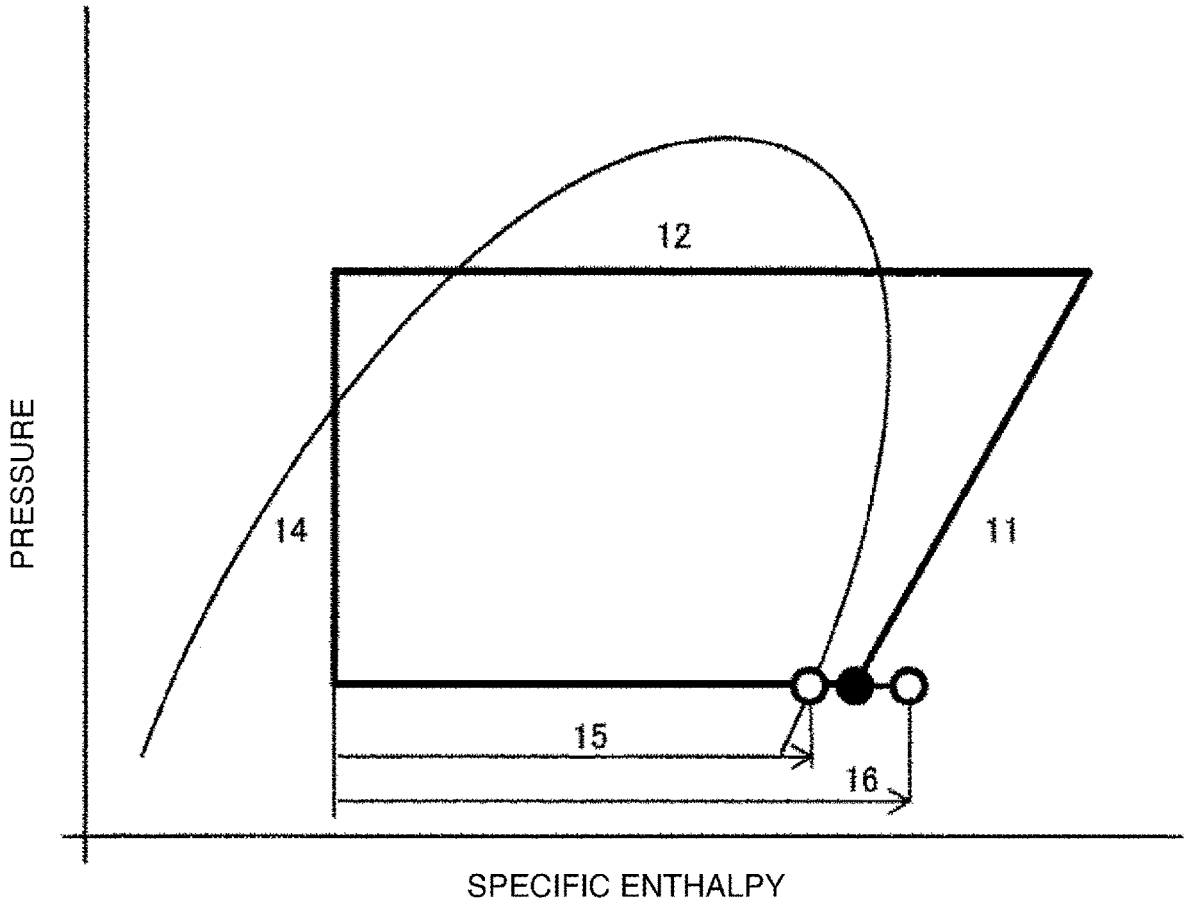
FIG. 7 shows a pressure-specific enthalpy diagram of a refrigeration cycle section in the third embodiment.

As illustrated in FIG. 6, in the third embodiment, the refrigerant circulation passage 18 is constructed by arranging the first evaporator 15 that cools and dehumidifies the intake air and the second evaporator 16 that cools the lubricating oil such that the refrigerant flows in parallel into the refrigerant compressor 11 and the expansion valve 14. Further, the refrigerant flow regulating valve 19 is provided in a branch part. As a result, it is possible to control the number of revolutions of the refrigerant compressor 11 and the throttle amount of the expansion valve 14 in accordance with a required dehumidifying amount detected depending on the temperature and humidity of the intake air, and control the flow ratio of the refrigerant flow regulating valve 19 so that the temperature of the lubricating oil in the intermediate oil supply part 102 is optimized. FIG. 7 illustrates a pressure-specific enthalpy diagram of the refrigeration cycle section illustrated in the third embodiment. As can be seen from FIG. 7, heating amounts of the refrigerant in the first evaporator 15 and the second evaporator 16 vary depending on the flow ratio controlled by the refrigerant flow regulating valve 19 and a heating degree of the refrigerant flowing in a heat exchanger. In addition, it can be seen that the average heating degree after the refrigerant has joined is the heating degree of the refrigerant flowing into the refrigerant compressor 11. Therefore, the number of revolutions of the refrigerant compressor 11 and the throttle amount of the expansion valve 14 are controlled in accordance with cooling and dehumidifying amounts required in the first evaporator 15, and the flow ratio required for the first evaporator 15 and the second evaporator 16 is appropriately controlled by the refrigerant flow regulating valve 19, whereby energy consumed in the refrigeration cycle section can be kept low. The air compression unit A provided according to the present third embodiment due to the above-described effects can be made to be highly reliable, and energy saving of the system can also be improved.

The blower 6 in the air compression section and the blower 13 in the refrigeration cycle section are illustrated as different blowers in the present embodiment; however, even if the aftercooler 4, the oil cooler 5, and the condenser 12 are arranged in the same air passage and the blowers are integrated together, a similar effect can be exerted.

To summarize the above, a vapor compression type refrigeration cycle is provided, in which the refrigeration cycle is constructed by annularly connecting a refrigerant compressor, a condenser, an expansion valve, a first evaporator, and a second evaporator together, and the intake air taken into the air compressor is caused to flow through a primary side of the first evaporator, the refrigerant is caused to flow through a secondary side of the first evaporator, the lubricating oil is caused to flow through a primary side of the second evaporator, and the refrigerant is caused to flow through a secondary side of the second evaporator, whereby the refrigeration cycle can be provided in which cooling and dehumidification of the intake air of the air compressor and cooling of the lubricating oil are performed simultaneously.

In addition, the air taken into the air compressor can be cooled and dehumidified by the first evaporator, and as a result, the dew point temperature of the air during compression also decreases. As a result, the temperature of the lubricating oil supplied to the air during compression can be made lower than that of the air of a case of not being cooled or dehumidified. As a result, shaft power of the air compressor can be reduced, and energy saving can be improved.

Further, the primary side of the second evaporator is provided in the middle of the oil supply pipeline connecting the oil cooler with the intermediate part of the compressor. With such a configuration, the lubricating oil is cooled by the atmosphere in the oil cooler, and then cooled by low temperature refrigerant. A heat load for cooling the lubricating oil in the refrigeration cycle can be reduced. For this reason, the energy consumed in the refrigeration cycle can be kept low.

Further, a discharge part on the secondary side of the first evaporator and an intake part on the secondary side of the second evaporator are connected together. With such a configuration of the pipeline, the refrigerant can be circulated through the secondary side pipeline of the evaporator sequentially in the order of the expansion valve, the first evaporator, and the second evaporator. Therefore, regarding the state of the refrigerant flowing through the secondary side of the first evaporator, since the two-phase region in which the temperature is stable can be used, the temperature and humidity of the intake air flowing into the air compressor can be controlled to a predetermined value.

Further, the first evaporator and the second evaporator are connected in parallel to the expansion valve and the intake part of the refrigerant compressor. In this case, it is possible to control the cooling and dehumidification capacity by the number of revolutions of the refrigerant compressor and control the dew point temperature of the intake air by the opening degree of the expansion valve, so that a similar effect as described above can be obtained even if the evaporators are connected in parallel. Further, since the first evaporator and the second evaporator are connected in parallel, the cooling amount of the lubricating oil and the dehumidifying amount of the intake air can be easily controlled by controlling the flow ratio of the refrigerant flowing through the secondary side of the evaporator.

Further, the flow directions of the lubricating oil flowing through the primary side of the second evaporator and the refrigerant flowing through the secondary side of the second evaporator are made to be opposite to each other. With such a configuration of the pipeline, even in a case where the state of the refrigerant flowing in the secondary side of the second evaporator changes from the two-phase region to the gas region, a temperature difference can be kept between the secondary side and the primary side, and even in a case where the temperature difference is relatively small, heat exchange efficiency of the heat exchanger can be maintained. For this reason, the energy consumed in the refrigeration cycle can be kept low.

Further, a control valve for controlling a circulating amount of the lubricating oil is provided in the middle of the oil supply pipeline connecting the oil cooler with the second evaporator. As a result, the flow rate and temperature of the lubricating oil can be controlled to those at which the air during compression can be cooled to the optimum temperature.

Further, the number of revolutions of the refrigerant compressor is controlled by the temperature and humidity of the intake air, the opening degree of the control valve is controlled in accordance with the number of revolutions of the refrigerant compressor and the dehumidifying amount of the intake air, and the lubricating oil supply amount is controlled by the control valve. With this configuration, the flow rate and temperature of the lubricating oil can be controlled to values corresponding to the dew point temperature of the compressed air.

REFERENCE SIGNS LIST

1 Air compressor
2 Motor
3 Oil separator
4 Aftercooler
5 Oil cooler
6 Blower
7 Air ventilation passage
8 Oil circulation passage
9 Oil supply control valve
11 Refrigerant compressor
12 Condenser
13 Blower
14 Expansion valve
15 First evaporator
16 Second evaporator
18 Refrigerant circulation passage
19 Refrigerant flow regulating valve
55 Relative humidity
101 Bearing oil supply part
102 intermediate oil supply part
A Air compression unit

The invention claimed is:

1. An air compressor comprising:

an oil-cooled air compressor that compresses intake air and discharges the air;

an oil separator that separates compressed air discharged from the air compressor body and lubricating oil from each other;

an oil cooler that cools the lubricating oil discharged from the oil separator with outside air;

an oil supply pipeline for supplying the lubricating oil discharged from the oil cooler to a bearing of the air compressor body and an intermediate part of the air compressor during compression; and an aftercooler that cools the air discharged from the oil separator with the outside air, wherein the air compressor, the oil separator, the oil cooler, and the aftercooler are connected together to supply high pressure air outside the compressor, the air compressor comprising a refrigeration cycle of a vapor compression type, wherein the refrigeration cycle is constructed by annularly connecting a refrigerant compressor, a condenser, an expansion valve, a first evaporator, and a second evaporator together, and cooling and dehumidification of the intake air of the air compressor and cooling of the lubricating oil are performed simultaneously by causing the intake air taken into the air compressor to flow through a primary side of the first evaporator, causing the refrigerant to flow through a secondary side of the first evaporator, causing the lubricating oil to flow through a primary side of the second evaporator, and causing the refrigerant to flow through a secondary side of the second evaporator.

2. The air compressor according to claim 1, wherein the second evaporator is provided in a middle of the oil supply pipeline connecting the oil cooler with an intermediate part for supplying the lubricating oil to air during compression of the air compressor.

3. The air compressor according to claim 1, wherein a discharge part on the secondary side of the first evaporator and an intake part on the secondary side of the second evaporator are connected together.

4. The air compressor according to claim 1, wherein an intake part on the secondary side of the first evaporator and an intake part on the secondary side of the second evaporator are connected in parallel to a discharge part of the expansion valve, and a discharge part on the secondary side of the first evaporator and a discharge part on the secondary side of the second evaporator are connected in parallel to an intake part of the refrigerant compressor.

5. The air compressor according to claim 2, wherein connection is made such that flow directions of the lubricating oil flowing through the primary side of the second evaporator and the refrigerant flowing through the secondary side of the second evaporator are opposite to each other.

6. The air compressor according to claim 1, wherein a control valve for controlling an oil supply amount of the lubricating oil is provided in an intermediate part of the oil supply pipeline connecting the oil cooler with the second evaporator.

7. The air compressor according to claim 2, wherein a discharge part on the secondary side of the first evaporator and an intake part on the secondary side of the second evaporator are connected together.

8. The air compressor according to-claim 2, wherein an intake part on the secondary side of the first evaporator and an intake part on the secondary side of the second evaporator are connected in parallel to a discharge part of the expansion valve, and a discharge part on the secondary side of the first evaporator and a discharge part on the secondary side of the second evaporator are connected in parallel to an intake part of the refrigerant compressor.

9. The air compressor according to claim 2, wherein a control valve for controlling an oil supply amount of the lubricating oil is provided in an intermediate part of the oil supply pipeline connecting the oil cooler with the second evaporator.

10. The air compressor according to claim 3, wherein a control valve for controlling an oil supply amount of the lubricating oil is provided in an intermediate part of the oil supply pipeline connecting the oil cooler with the second evaporator.

11. The air compressor according to claim 4, wherein a control valve for controlling an oil supply amount of the lubricating oil is provided in an intermediate part of the oil supply pipeline connecting the oil cooler with the second evaporator.

12. The air compressor according to claim 5, wherein a control valve for controlling an oil supply amount of the lubricating oil is provided in an intermediate part of the oil supply pipeline connecting the oil cooler with the second evaporator.

* * * * *